United States Patent [19]

Dutcher

[11] 4,210,271

[45] Jul. 1, 1980

[54] TUB-SHAPED CARTON AND BLANK FOR FORMING SAME

[75] Inventor: Daniel P. Dutcher, Woodbury, Minn.

[73] Assignee: Champion International Corporation, Stamford, Conn.

[21] Appl. No.: 924,655

[22] Filed: Jul. 14, 1978

Related U.S. Application Data

[63] Continuation-in-part of Ser. No. 829,720, Sep. 1, 1977, Pat. No. 4,153,196.

[51] Int. Cl.[2] ..... B65D 3/04; B65D 5/24

[52] U.S. Cl. ..... 229/1.5 B; 229/21; 229/31 R

[58] Field of Search ..... 229/1.5 B, 21, 31

[56] References Cited

U.S. PATENT DOCUMENTS

| | | | |
|---|---|---|---|
| 1,122,614 | 12/1914 | Kraus | 229/1.5 B UX |
| 1,555,054 | 9/1925 | Berkowitz | 229/31 R X |
| 1,623,715 | 4/1927 | Berkowitz | 229/31 R X |
| 1,892,715 | 1/1933 | Wellman | 229/21 X |
| 1,982,557 | 11/1934 | Watson | 229/31 R |
| 3,381,877 | 5/1968 | Arneson | 229/1.5 B X |
| 3,533,332 | 10/1970 | Young et al. | 229/1.5 B X |
| 3,633,814 | 1/1972 | Michetti | 229/21 |
| 3,733,023 | 5/1973 | Arneson | 229/1.5 B X |

*Primary Examiner*—Davis T. Moorhead

*Attorney, Agent, or Firm*—Evelyn M. Sommer

[57] ABSTRACT

A generally cylindrical, tub-shaped carton having a flat bottom, and particularly suited for containing butter or margarine, is formed of a single paperboard blank, and is characterized by having a generally cylindrical-shaped side wall formed of two panels, each of which is integrally formed with and hingedly connected to one of two opposing sides of a hexagonal horizontal base portion. Intermediate each of the remaining sides of said hexagonal base portion and a side wall panel is an articulated webbed corner which, in the erected position of the carton, is wholly disposed within the tub-shaped carton in a flattened relationship against said side wall panels to reinforce the side wall seam of the tub-shaped carton. The hexagonal base or bottom of the carton is flat, thereby offering a more stable carton having greater capacity at a reduced cost of manufacture, and also offering better sealing of the carton during packaging of the butter therein.

2 Claims, 8 Drawing Figures

TUB-SHAPED CARTON AND BLANK FOR FORMING SAME

CROSS-REFERENCE TO RELATED APPLICATION

This is a continuation-in-part of application Ser. No. 829,720 filed Sept. 1, 1977 now U.S. Pat. No. 4,153,196 which issued May 8, 1979.

BACKGROUND OF THE INVENTION

The present invention relates to a new and improved carton, and more particularly a generally cylindrical tub-shaped carton and blank for making same, which is particularly suited for containing a food product, such as butter or margarine. The carton of the subject invention is formed of a single sheet of paperboard material having a new and unique configuration so as to result in a cylindrical container, having an unobstructed top portion, and a flat, reinforced rigid base portion, thereby greatly facilitating the loading of the carton with butter or margarine, and offering increased capacity, at a reduced manufacturing cost of the carton. In addition, when employing conventional carton filling equipment, the flat bottom offers improved sealing capability of the resulting carton even under application of a mandrel pressure during packaging of the food products into the carton.

Heretofore, semi-soft food products, such as butter or margarine, have been packaged in paper outer wrappers, and more recently in molded plastic containers of generally tub-shaped configuration. Because of the molding operation and the cost of manufacture, it is appreciated that the cost of the resulting plastic container is relatively high, as compared to a container formed of a paper or paperboard material. It is also known to provide cartons of tub-shaped configuration formed of a single paperboard blank wherein, in order to achieve a cylindrical configuration of the carton from a single blank, the base of the resulting carton has included arcuate portions or depressions, thereby decreasing the volume of the resulting carton, and creating, in effect, false bottoms in the carton. Furthermore, with such depressions or false bottoms, the resulting base of such carton is not flat, and thus is less stable than desired, especially during filling of the carton with the food product.

SUMMARY OF THE INVENTION

It is an object of the subject invention to overcome the shortcomings of the prior art paperboard cartons, and to provide a new and improved tub-shaped carton having a reinforced flat bottom, and yet formed of a single sheet of paperboard material. In the subject invention, a tub-shaped carton is formed of a single sheet of paperboard material and basically comprises two side wall panels each of which is hingedly connected to one of two opposed sides of a horizontally disposed hexagonal base. Closure means such as an intermediate articulated webbed corner is integrally formed with and hingedly connected between each of the remaining sides of the base portion and a side wall panel, and in the erected condition of the carton, the articulated webbed corners are folded so as to be wholly disposed within the tub-shaped carton, and either in a position contiguous with and overlying a wall panel for reinforcing same, and at the same time insuring that the bottom of the tub-shaped carton is totally flat or, in an alternate embodiment, the webbed corner is replaced with a triangular panel integrally formed with and attached along the longest side thereof to either the bottom edge of each end of each side wall panel or to each of the remaining side edges of said base whereby the triangular panel may be positioned in a flattened condition against said base or in a flattened condition against said side wall panels.

BRIEF DESCRIPTION OF THE DRAWINGS

Further objects and advantages of the invention will become apparent from the following detailed description taken in conjunction with the figures in which.

DETAILED DESCRIPTION

Figure 1:
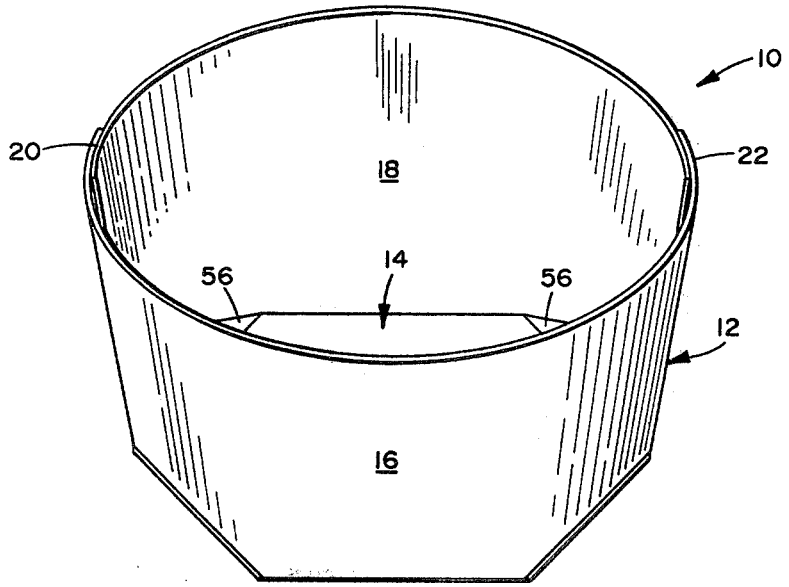
FIG. 1 is a perspective view of a tub-shaped carton of the subject invention.
Figure 2:
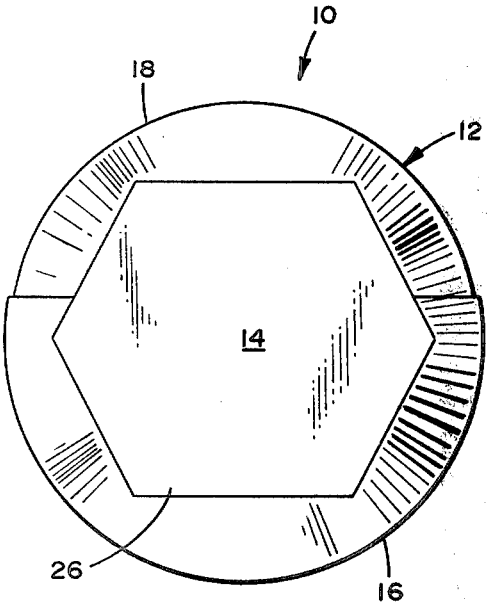
FIG. 2 is a bottom view of the tub-shaped carton of the subject invention.
Figure 3:
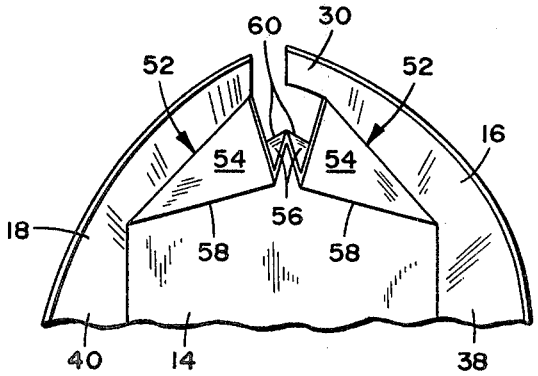
FIG. 3 is a partial perspective view of a tub-shaped carton of the subject invention during a stage of the erection of the carton.

Referring to FIGS. 1 through 3, the tub-shaped carton of the subject invention is generally cylindrical in configuration and designated by the numeral 10. Preferably the carton is formed of a single sheet of paperboard material, with the blank for forming the carton being illustrated in FIG. 4. As shown in FIGS. 1 through 3, tub-shaped carton 10 includes upstanding side wall 12 which is hingedly connected to a horizontally disposed base portion 14 that is generally flat. The side wall 12 is formed by two generally arcuate panels 16 and 18 which are connected along opposed wall seams 20 and 22, such as by bonding with adhesive material. As shown in FIGS. 2 and 3, the hexagonal base or bottom 14 of the carton 10 is a flat surface.

Figure 4:
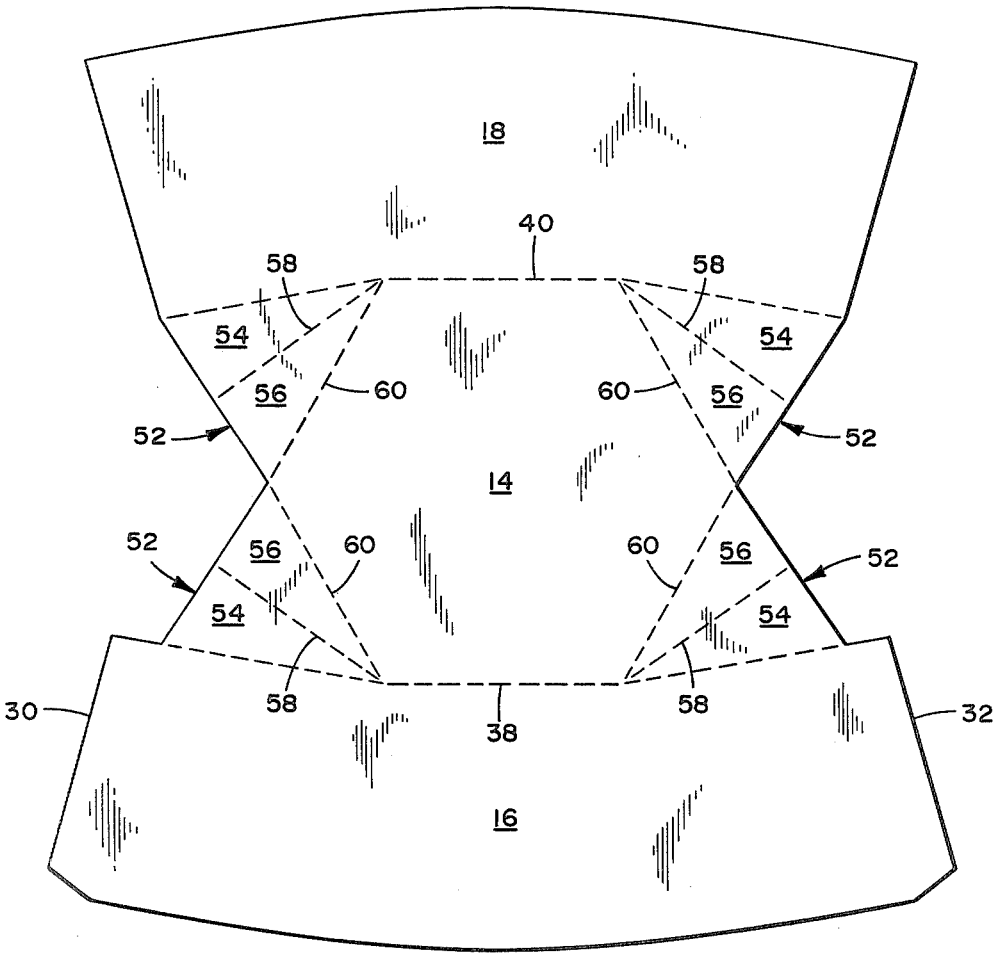
FIG. 4 is a plan view of a blank for forming the tub-shaped carton of the subject invention.

Referring to FIG. 4, the blank for forming carton 10 is preferably formed of a single sheet of paperboard material and includes first side wall panel 16 that has a generally arcuate top edge and a bottom edge that is congruent with three sides of the hexagonal base 14. The middle portion of said bottom edge is congruent with, hingedly attached to and integrally formed with base portion 14 along hinge line 38. Disposed on opposite ends of first side wall panel 16 are glue flaps 30 and 32 which form seams 20 and 22, as shown in FIG. 1. The second side wall panel 18 is congruent with side wall panel 16 except for the glue flaps and the middle portion of the bottom edge thereof, is hingedly connected to and integrally formed with the opposite side of base portion 14 along hinge line 40. Integrally formed with and hingedly connected to one of the equal length sides 60 of the hexagonal base 14 as well as to one of the side panels 16 or 18, is one of four closure means which are shown as intermediate webbed corners, designated by the numeral 52. Each webbed corner 52 is closed by and includes two articulated, generally triangular segments 54 and 56 which are integrally formed with each other hingedly connected along line 58, and hingedly connected to and integrally formed with hexagonal base 48 along hinge line 60. Segment 54 of each intermediate webbed corner 52 is, in turn, hingedly connected to and integrally formed with the adjacent first or second side panels along hinge lines 38 and 40, respectively.

Figure 6:
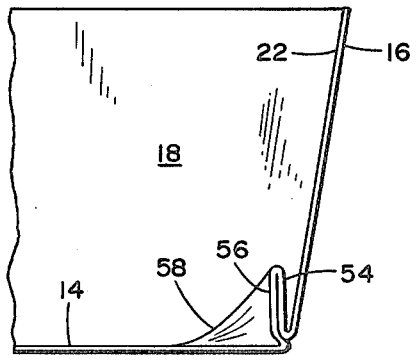
FIG. 6 is a sectional view taken along line 6—6 in FIG. 5.

As shown in FIG. 3, during the erection of carton 10, each intermediate webbed corner 52 is folded about its central hinge line 58, and then about its associated hinge line 60 and hinge lines 38 or 40 so that each intermediate webbed corner is disposed wholly within the confines of the resulting tub-shaped carton. The partial erected position of the carton 10 is illustrated in FIG. 3, and it is noted that intermediate webbed corners 52 may be in a flattened condition folded against said side wall panels 16 or 18. In the final erected condition of the carton 10, glue flaps 30 and 32 are bonded to the opposed edges of the second side panel 18. At such time, the triangular-shaped segments 54 and 56 of each intermediate webbed corner 52 are in contiguous disposition, and folded in flattened condition against wall panels 16 and 18 as shown in FIG. 6. The entire bottom or hexagonal base 14 of the carton 10 is flat, and as such does not present a false bottom, thereby resulting in a more structurally stable carton providing greater interior volume.

Figure 5:
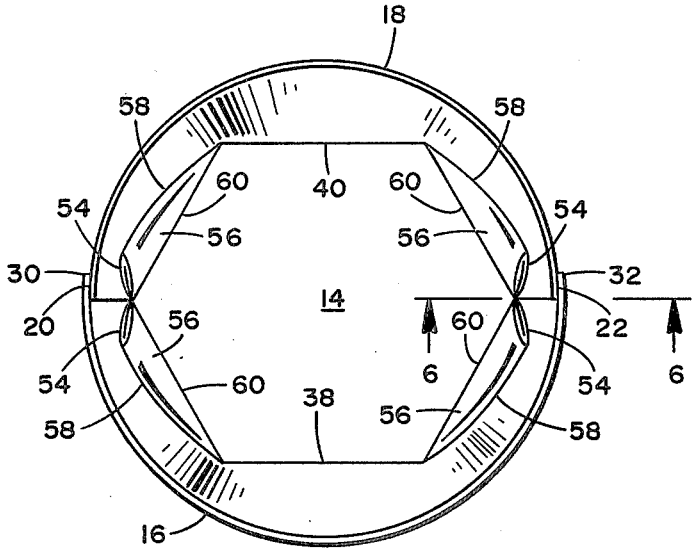
FIG. 5 is a top view of the preferred embodiment of the tub-shaped carton of FIG. 1.

The preferred embodiment is shown in FIGS. 5 and 6 wherein the triangular-shaped segments 54 and 56 of each webbed corner 52 are in contiguous disposition and glued or otherwise attached in flattened condition to wall panels 16 and 18. Glue may be applied to segment 54 to cause it to adhere to wall panel 16 or 18. The base 14 of the tub-shaped carton is then totally flat for greater stability and the side wall seams 20 and 22 are strengthened at the base thereof.

Figure 7:
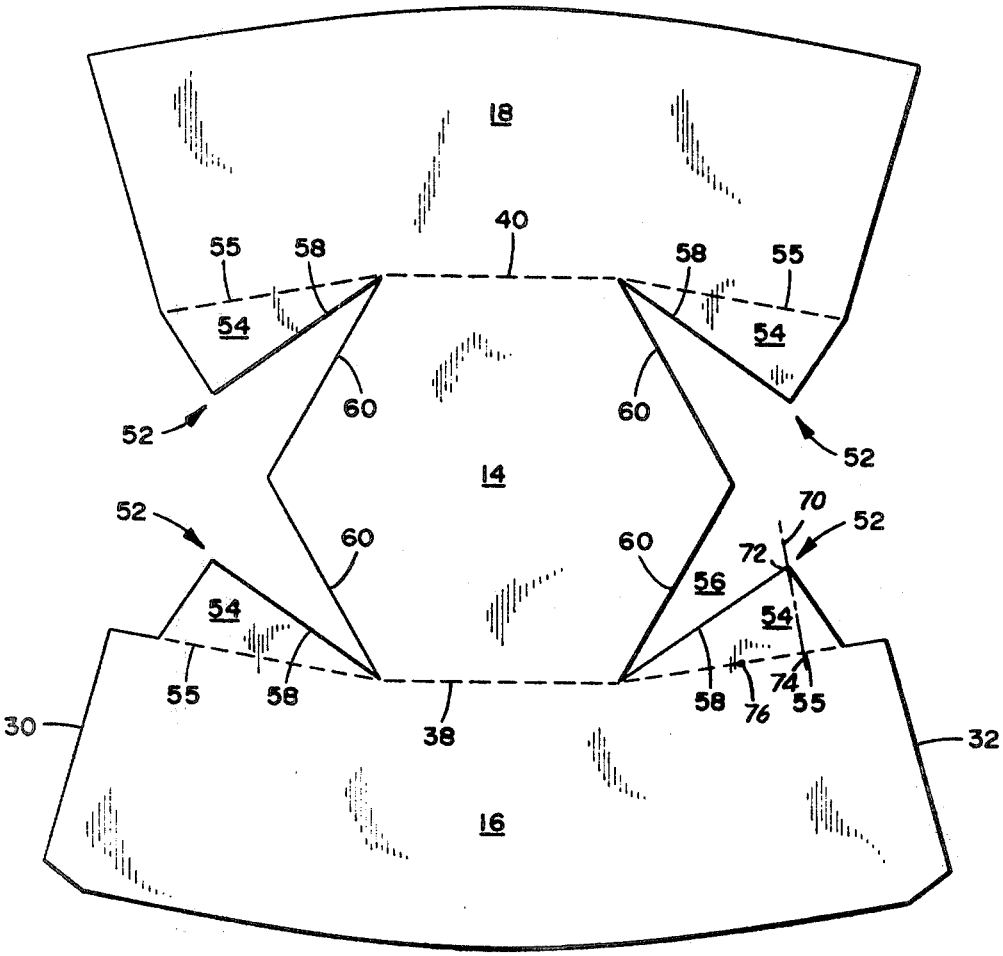
FIG. 7 is a plan view of a blank for forming the tub-shaped carton of a first alternate embodiment wherein the corner closure means is a triangular segment which may be positioned in a flattened condition against said base.

FIG. 7 discloses the blank for forming a tub-shaped carton of a first alternate embodiment in which means 52 for closing each corner between a side wall panel 16 or 18 and one of the remaining side edges 60 of the base 14 is a triangular panel 54. Panel 54 is integrally formed with an attached along the longest side 55 thereof to the bottom edge of each end of each side wall panel 16 and 18. It will be understood that when the carton blank of FIG. 7 is folded each of said triangular panels 54 is folded about articulation 55 and is positioned in a flattened condition on said base 14. This configuration allows a flatter fold than the webbed corners.

Figure 8:
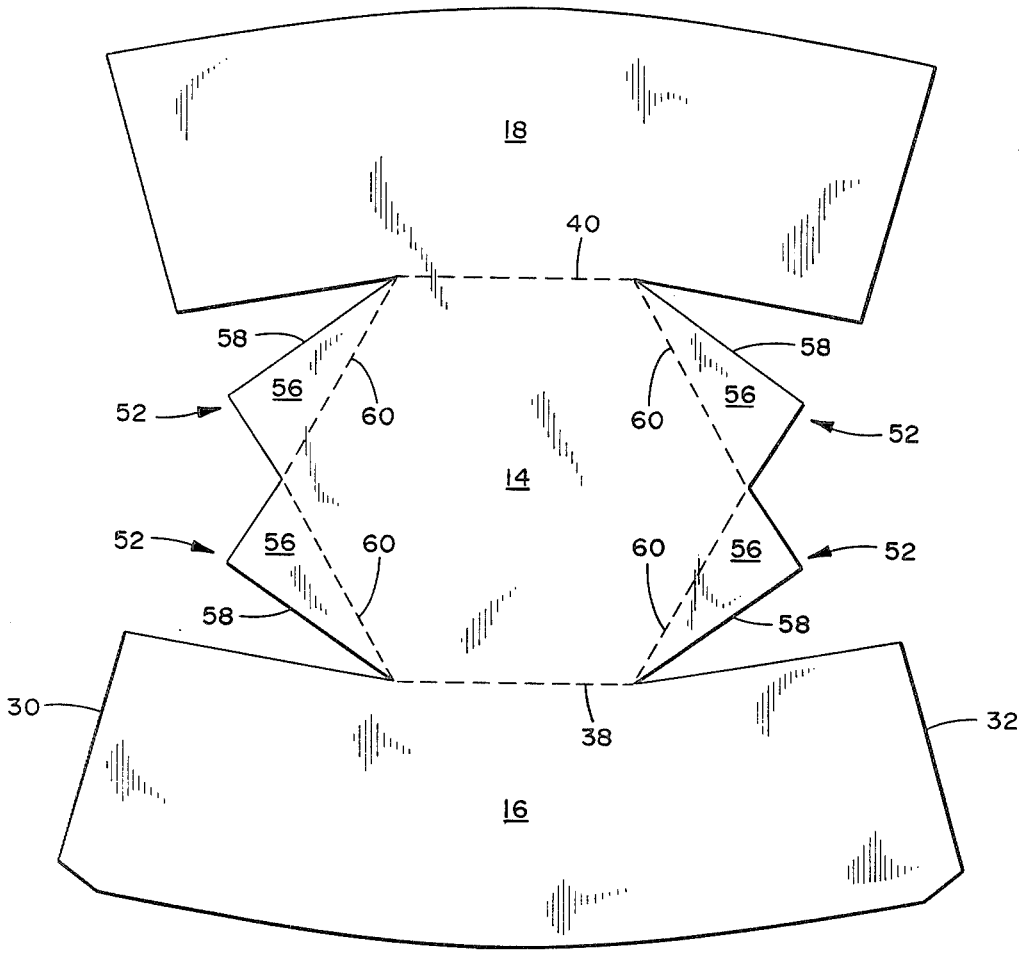
FIG. 8 is a plan view of a blank for forming the tub-shaped carton of a second alternate embodiment wherein the corner closure means is a triangular segment which may be positioned in a flattened condition against the carton side walls.

FIG. 8 discloses a blank for forming a tub-shaped carton of a second alternate embodiment in which means 52 for closing each corner between a side wall panel 16 or 18 and one of the remaining side edges 60 of the base 14 is also a triangular panel 56. However, unlike the embodiment of FIG. 7, in the embodiment, triangular panel 56 is integrally formed with and attached along the longest side 60 thereof to each of the remaining side edges of said base 14. In this case, when the carton blank is folded, each of said triangular panels 56 is folded about articulation 60 and is positioned in a flattened condition against an adjacent side wall panel 16 or 18. This configuration allows not only a smooth base 14 but also allows smoother interior walls inasmuch as triangular panels 56 are only half as thick as the webbed corners in the preferred embodiment shown in FIG. 4.

In contrast to the embodiment of the tub-shaped car shown in FIGS. 1, 3–6, the blanks shown in FIGS. 7 and 8 include a single triangular panel 54 or 56 having the base edge thereof formed integral with the hexagonal base 14 (FIG. 8) or the corresponding side wall panel 16 or 18, while the remaining two edges of such triangular panels 54 or 56 are individually defined by cut lines. Each of the triangular panels 54 or 56 are significantly shaped such that an altitude reference line extending perpendicular to the base edge of such panel through the vertex thereof defined by the intersection of the two remaining edges intersects such base edge at an area therealong which is spaced from the mid-point thereof, in a direction toward the corresponding side wall seam. Thus, for example, in FIG. 7, the altitude reference line 70 extends perpendicular to the base edge or longest side 55 and passes through the vertex 72. Reference line 70 intersects the base edge or longest side 55 at an area 74 which is spaced from the mid-point 76 in a direction toward the glue flap 32. This feature of the invention is particularly important where single ply closing means 52 in the nature of a single panel 54 or 56 is employed because of the fact that the strength of the side wall 12 of the carton 10 in the radially outward direction is least at the seams 20 and 22 defined by glue flaps 30 and 32. In other words, that portion of the lower edges of side wall panels 16 and 18 along hinge lines 38 and 40 is held in place against the hexagonal base 14 by virture of the fact that the base 14 is formed integral with such side wall panels 16 and 18; however, the magnitude of force tending to urge the opposite extremities of the side wall panels 16 and 18 outwardly away from the base 14 when the carton is in its erected condition due to the natural outward biasing of the material forming the side wall panels 16 and 18 increases rapidly in accordance with the circumstantial distance measured from the hinge lines 38 and 40 to the seams 20 and 22. The uniquely configured triangular panels 54 or 56 provide, however, increased surface area to be bonded either to the base 14 or the side wall panels 16 and 18 in accordance with increased distance away from the hinge lines 38 and 40 toward the seams 20 and 22; this increases the strength of the attachment bond between the base 14 and side wall panels 16 and 18 in proportion to the increased outwardly directed pressure imposed on the side wall panels 16 and 18 by the natural resiliency of the paperstock as well as by the contents within the carton 10.

Accordingly, there is provided a new and improved tub-shaped carton, particularly suited for use in containing foodstuffs, such as butter or margarine, and which is formed of a single paperboard blank. The resulting carton has a structurally reinforced flat bottom, which is achieved by the new and improved structure of applicant's carton blank, which blank structure, when fully erected, provides the desired configuration of the carton, and the required strength for packaging of the foodstuffs. Since the blank is formed from a single blank paperboard material, the resulting cost of manufacture of the carton is less than heretofore achieved, especially compared to cartons formed of molded plastic articles. Furthermore, the flat hexagonal bottom of the subject carton provides a more stable structural carton than heretofore achieved from paperboard cartoons having false bottoms or depressions.

Although the invention has been described with respect to a single embodiment, it is readily apparent that various modifications or alterations may be made in the subject carton and blank for forming same, without departing from the spirit and scope of the invention as defined by the appended claims.

What is claimed is:

1. A tub shaped carton comprising:

(a) a hexagonal base (b) a cylindrically-shaped side wall formed of first and second side wall panels joined at side wall seams, (i) each of said side wall panels having a generally arcuate top edge and (ii) a bottom edge congruent with three sides of said hexagonal base, (iii) the middle portion of said bottom edge of each side wall panel being congruent with, hingedly connected to and integrally formed with one of opposing sides of said hexagonal base, and (c) closure means attached between each of the remaining sides of said hexagonal base and an adjacent side wall panel to close the space therebetween, said closure means comprising a single ply, triangular panel having one edge thereof formed integral with portions of said carton adjacent said bottom edge of said side wall, the remaining two edges of said triangular panel being individually defined by cut lines, and wherein an altitude reference line extending perpendicular to the base edge of said triangular panel and through the vertex of said triangular panel opposite said base edge thereof intersects said base edge at an area along said base edge spaced from the mid-point of said base edge in a direction toward the corresponding side wall seam, portions of said triangular panel immediately adjacent said reference line presenting increased surface area which is adhesively attached between said hexagonal base and said adjacent side wall panel whereby to strengthen the attachment between said hexagonal base and said first and second side wall panels adjacent said side wall seams, each of said triangular panels having one face thereof adhesively bonded to interior surface areas of said hexagonal base, said triangular panels being positioned in a flattened condition against said hexagonal base, said base edge of each of said triangular panels being hingedly connected by a fold line to a corresponding one of said first and second side wall panels.

2. A blank comprising a single sheet of paperstock for forming the tub-shaped carton of claim 1.

* * * * *